US010968662B2

(12) United States Patent
Dunnigan et al.

(10) Patent No.: US 10,968,662 B2
(45) Date of Patent: Apr. 6, 2021

(54) DUAL LOCK SYSTEM

(71) Applicant: dormakaba USA Inc., Madison Heights, MI (US)

(72) Inventors: Adam Dunnigan, Lexington, KY (US); Brian Craycraft, Lexington, KY (US); James Lawhorn, DuQuoin, IL (US); Kenney Clay Sledd, Paris, KY (US)

(73) Assignee: dormakaba USA Inc., Indianapolis, IN (US)

( * ) Notice: Subject to any disclaimer, the term of this patent is extended or adjusted under 35 U.S.C. 154(b) by 259 days.

(21) Appl. No.: 16/198,020

(22) Filed: Nov. 21, 2018

(65) Prior Publication Data

US 2019/0194975 A1 Jun. 27, 2019

Related U.S. Application Data

(60) Provisional application No. 62/589,036, filed on Nov. 21, 2017.

(51) Int. Cl.
*E05B 59/00* (2006.01)
*E05B 53/00* (2006.01)
(Continued)

(52) U.S. Cl.
CPC ..... *E05B 59/00* (2013.01); *E05B 37/0031* (2013.01); *E05B 37/0034* (2013.01); *E05B 53/00* (2013.01); *E05B 63/0004* (2013.01); *E05B 65/1053* (2013.01); *E05C 1/06* (2013.01); *E05B 63/10* (2013.01); *E05B 2015/0486* (2013.01); *E05Y 2900/132* (2013.01)

(58) Field of Classification Search
CPC ..... E05B 59/00; E05B 53/00; E05B 37/0034; E05B 63/0004; E05B 37/0031; E05B 65/1053; E05B 2015/0486; E05B 63/10; E05B 53/003; E05B 63/14; E05B 63/16; E05C 1/06
USPC ..... 70/107–111, 92, 465, DIG. 63; 292/21, 292/92, 35, 36, 39, 41
See application file for complete search history.

(56) References Cited

U.S. PATENT DOCUMENTS 3,390,558 A * 7/1968 Hegedus ..... E05B 59/00 70/107
3,791,180 A * 2/1974 Doyle ..... E05B 59/00 70/107

(Continued)

*Primary Examiner* — Lloyd A Gall
(74) *Attorney, Agent, or Firm* — Norton Rose Fulbright US LLP

(57) ABSTRACT

The dual lock system can have a primary lock having a first bolt, a first external access control interface, a handle on an internal face of the door, a first mechanism to control the retraction of the first bolt based on either one of the first external access control interface and the handle, the first mechanism having an actuator which is moveable vertically in response to the activation of the handle; a secondary lock having a second bolt, a second external access control interface, a second mechanism to control the retraction of the second bolt based on the second external access control interface, the second mechanism having a rotary shaft linked to the retraction of the second bolt; a connecting element connected to transfer the vertical movement of the actuator to a rotary movement of the rotary shaft, wherein both the first bolt and the second bolt are retracted upon activation of the handle.

20 Claims, 12 Drawing Sheets

(51) Int. Cl.

| | |
|---|---|
| ***E05B 63/00*** | (2006.01) |
| ***E05B 15/04*** | (2006.01) |
| ***E05C 1/06*** | (2006.01) |
| ***E05B 37/00*** | (2006.01) |
| ***E05B 65/10*** | (2006.01) |
| *E05B 63/10* | (2006.01) |

(56) References Cited

U.S. PATENT DOCUMENTS 3,875,772 A * 4/1975 Ebersman ..... E05B 59/00 70/107
4,109,494 A * 8/1978 Allemann ..... E05B 53/003 70/107
4,418,552 A * 12/1983 Nolin ..... E05B 59/00 292/21
4,606,203 A * 8/1986 Esser ..... E05B 59/00 70/107
4,635,453 A * 1/1987 Hart ..... E05B 55/005 70/134
4,961,330 A * 10/1990 Evans ..... E05B 47/0603 292/92
4,995,248 A * 2/1991 Liu ..... E05B 47/0692 70/107
5,077,992 A * 1/1992 Su ..... E05B 59/00 292/36
5,269,162 A * 12/1993 Robida ..... E05B 17/04 70/224
5,513,505 A * 5/1996 Dancs ..... E05B 47/026 292/169.13
5,590,917 A 1/1997 Brooks et al.
5,713,612 A * 2/1998 Kajuch ..... E05B 53/00 292/36
6,454,322 B1 * 9/2002 Su ..... E05B 59/00 292/244
9,982,461 B1 * 5/2018 Kilbourne ..... E05B 17/0037
2004/0107747 A1 * 6/2004 Chang ..... E05B 65/1086 70/107
2011/0314878 A1 * 12/2011 Roth ..... E05B 59/00 70/107
2016/0115720 A1 * 4/2016 Wong ..... E05B 65/1086 292/34

* cited by examiner

DUAL LOCK SYSTEM

CROSS-REFERENCE TO RELATED APPLICATIONS

The present patent application claims the benefit of U.S. Provisional Patent Application No. 62/589,036 filed on Nov. 21, 2017, the entire content of which is incorporated herein by reference.

TECHNICAL FIELD

The present patent application generally relates to door hardware, and more specifically to a lock system for a door.

BACKGROUND

Some doors require both a primary lock and a secondary lock. Such different locks can have different security and convenience levels. For example, the secondary lock can be a high-security lock for which design emphasis is placed on security rather than convenience, and the primary lock can be a lower security lock in which more design emphasis is placed on convenience. The secondary lock can be activated or deactivated less frequently than the primary lock. For instance, the secondary lock can be deactivated (e.g. have a deadbolt thereof retracted) at the beginning of a work shift, and re-activated at the end of a work shift. In such a configuration, access is conveniently and frequently controlled using the primary lock (which can conveniently be provided with a latch bolt for instance) during the work shift and higher security is provided by the secondary lock when authorized personnel is no longer present on the premises.

In addition to being subject to security specifications, such dual lock systems can also be subject to safety specifications. Indeed, it can be required for such dual lock system to provide capability of fast and convenient egress should an emergency, such as a fire alarm, occur. U.S. Pat. No. 5,590,917, for instance, presents an example dual lock system wherein both the primary and the secondary locks can be simultaneously unlocked from the inside by the push of a "panic-bar" handle.

While dual locking systems were satisfactory to a certain degree, there remained room for improvement.

SUMMARY

In accordance with a first aspect, a dual locking system is provided for a turn-lever handle primary lock.

In accordance with a second aspect, an improved dual lock system is provided for use with a panic-bar handle or a paddle handle. The improved dual lock system can have a limited thickness and satisfactory robustness, for instance.

In accordance with one aspect, there is provided a dual lock system for a door, the dual lock system comprising: a primary lock having a first bolt, a first external access control interface, a handle on an internal face of the door, a first mechanism to control the retraction of the first bolt based on either one of the first external access control interface and the handle, the first mechanism having an actuator which is moveable vertically in response to the activation of the handle; a secondary lock having a second bolt, a second external access control interface, a second mechanism to control the retraction of the second bolt based on the second external access control interface, the second mechanism having a rotary shaft linked to the retraction of the second bolt; a connecting element connected to transfer the vertical movement of the actuator to a rotary movement of the rotary shaft, wherein both the first bolt and the second bolt are retracted upon activation of the handle.

In the context of the specification, the expression "vertical" is not to be interpreted to mean strictly vertical. For instance, the movement of the actuator can be considered vertical even if it, in fact, forms more specifically part of a generally upward or downward pivoting movement.

Many further features and combinations thereof concerning the present improvements will appear to those skilled in the art following a reading of the instant disclosure.

DESCRIPTION OF DRAWINGS

For a more complete understanding of the present invention, reference is now made to the following descriptions taken in conjunction with the accompanying figures, in which.

Figure 1:
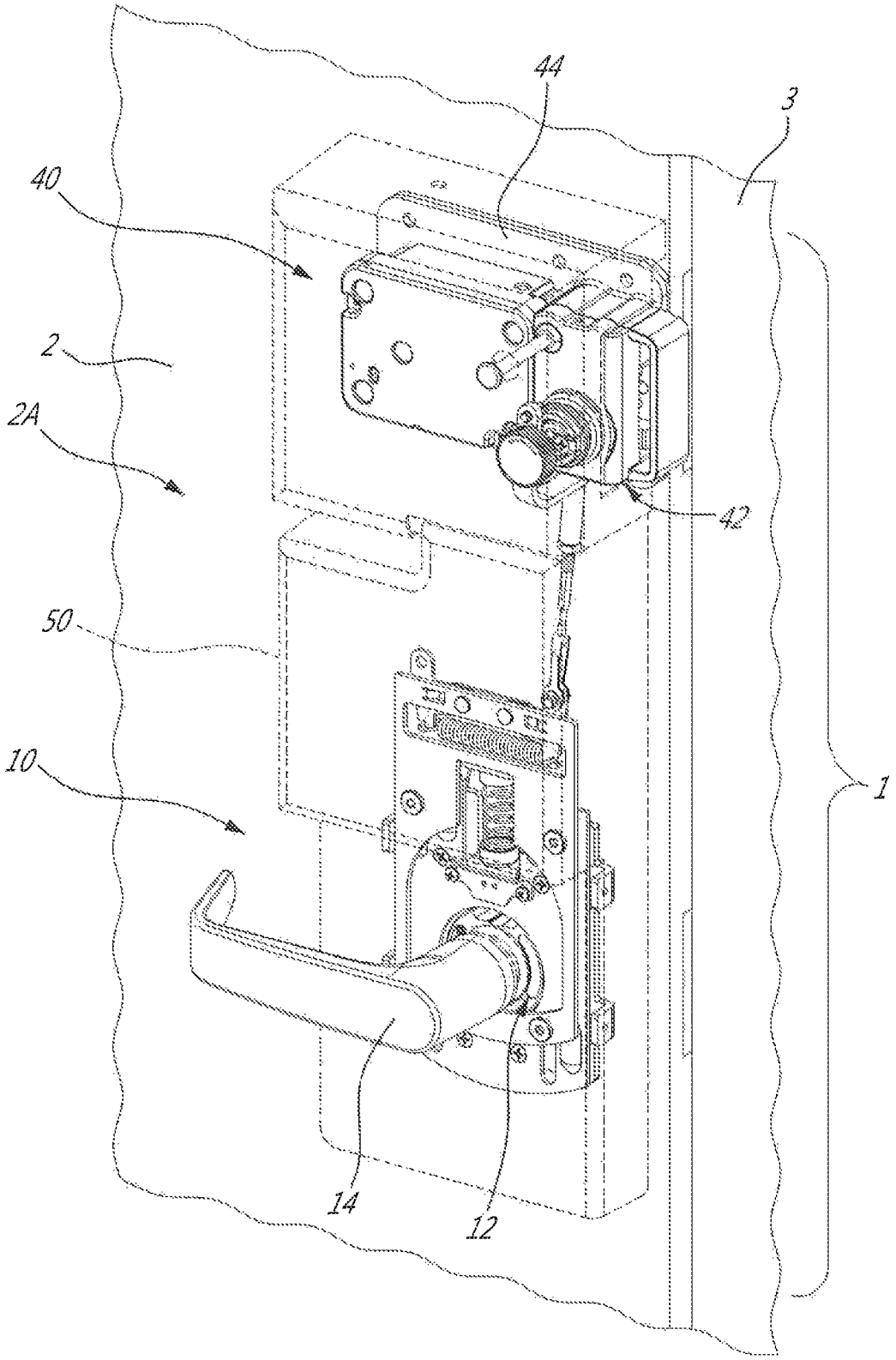
FIG. 1 is an oblique view of an example of a dual lock system.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

DETAILED DESCRIPTION

FIGS. 1 to 4 show an example of a dual lock system 1 mounted to a door 2. The dual lock system 1 includes a primary lock 10 and a secondary lock 40, each having a corresponding mechanism for the purpose of controlling the movement of a corresponding bolt upon an external activation of a corresponding access control interface. In other words, the access control interface of the primary lock is a first access control interface of the dual lock system 1, and the access control interface of the secondary lock is a second access control interface of the dual lock system 1; and similarly, the mechanism of the primary lock is a first lock/bolt retraction mechanism 12 for the purpose of controlling the movement of a first bolt 13 and the mechanism is a second lock/bolt retraction mechanism 42 for the purpose of controlling the movement of a second bolt 43. In this example, the secondary lock 40 can be a high-security lock for which emphasis is placed on security rather than convenience, and the primary lock 10 can be a lower security lock in which more emphasis is placed on convenience. For instance, the second bolt 43 of the secondary lock 40 can be a deadbolt, and require specific operation of the corresponding second access control interface to extend and to retract the deadbolt for respectively engaging and disengaging a deadbolt receiving aperture (not shown) in a door frame 3, thereby correspondingly locking and unlocking the door 2, whereas the first bolt 13 of the primary lock 10 can have a latch bolt and require operation of the corresponding first access control interface only for retraction thereof, whereby the latch bolt may disengage from a latch bolt receiving aperture (not shown) in the door frame 3, as extension of the latch bolt may be automatic (e.g. spring-biased). The second access control interface can be a high security access control interface, such as a combination dial D (not shown in FIG. 1, but such as the one shown in FIG. 5), for instance, whereas the first access control interface can be of lower, yet satisfactory, security level while being more convenient for frequent access, such as a key/keyhole interface 11' (not shown in FIG. 1, but such as the one shown in FIG. 5), for instance.

It will be noted that for better security, the external access controls of both locks 10, 40 can be made completely independent, requiring fully independent authentication by both access control interfaces to open the door 2 when both bolts, for instance the deadbolt and the latch bolt discussed above, are engaged in a respective receiving aperture of the door frame 3. However, for safety, from the inside, both bolts are simultaneously mechanically retractable by the single activation of an internal handle 14. The external authentication independence can be achieved while also providing simultaneous internal bolts retraction ability by using unilateral mechanical links between the handle and both lock mechanisms 12, 42 as will be exemplified below.

Figure 2:
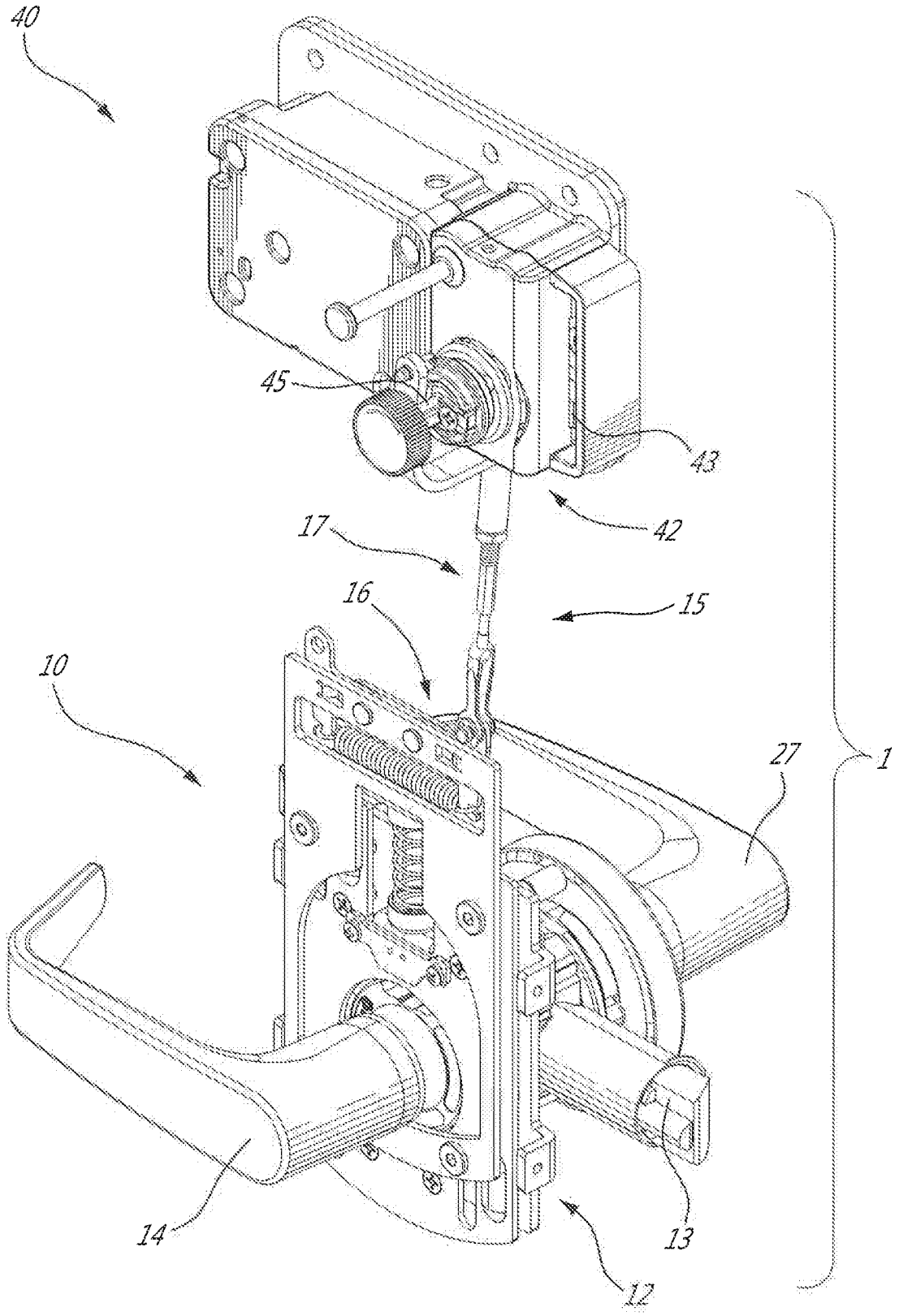
FIG. 2 is an oblique view of some components of the dual lock system of FIG. 1 showing more detail.
Figure 3A:
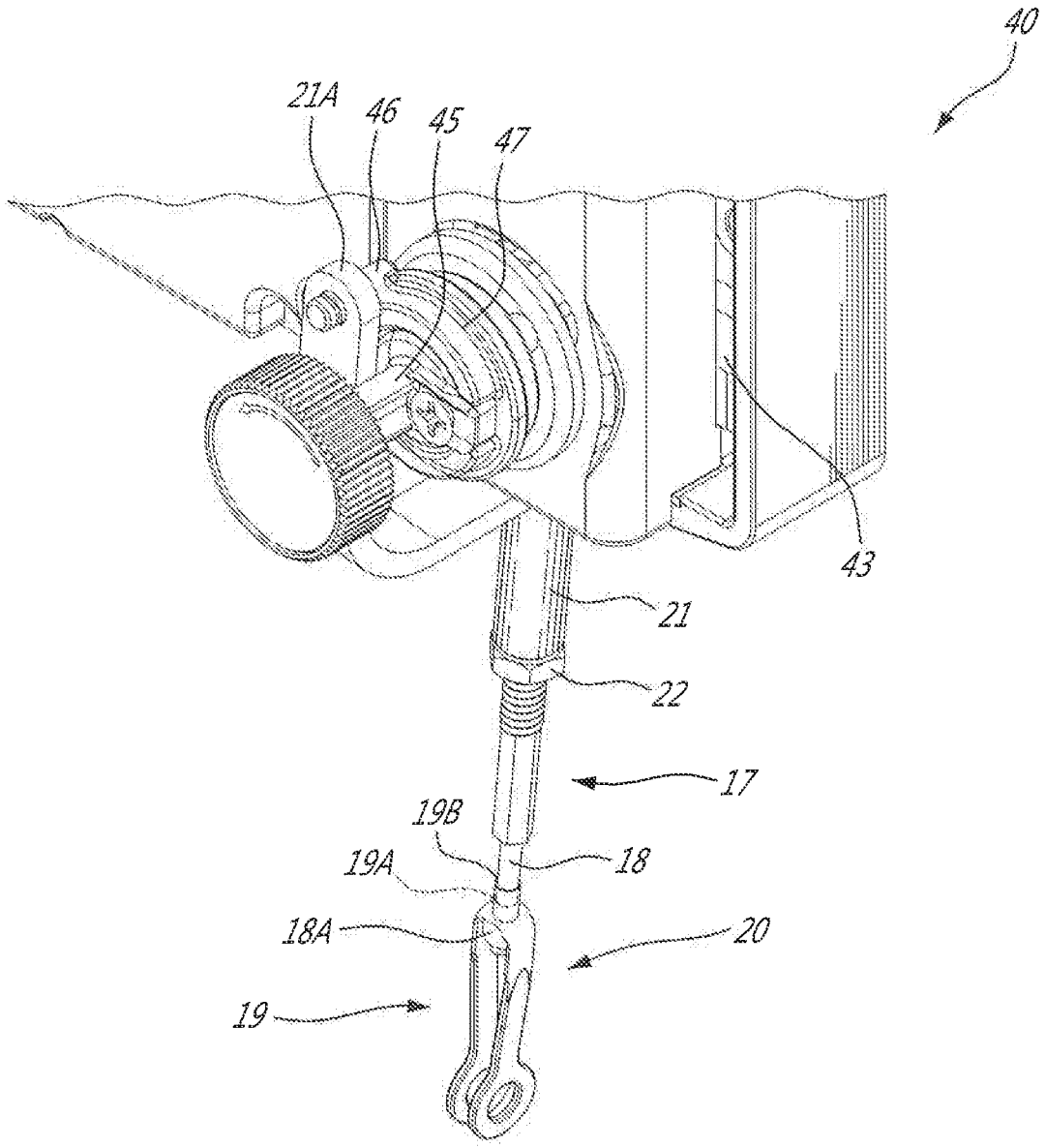
FIG. 3A is an oblique view of even fewer components of the dual lock system of FIG. 1, showing more detail.
Figure 3B:
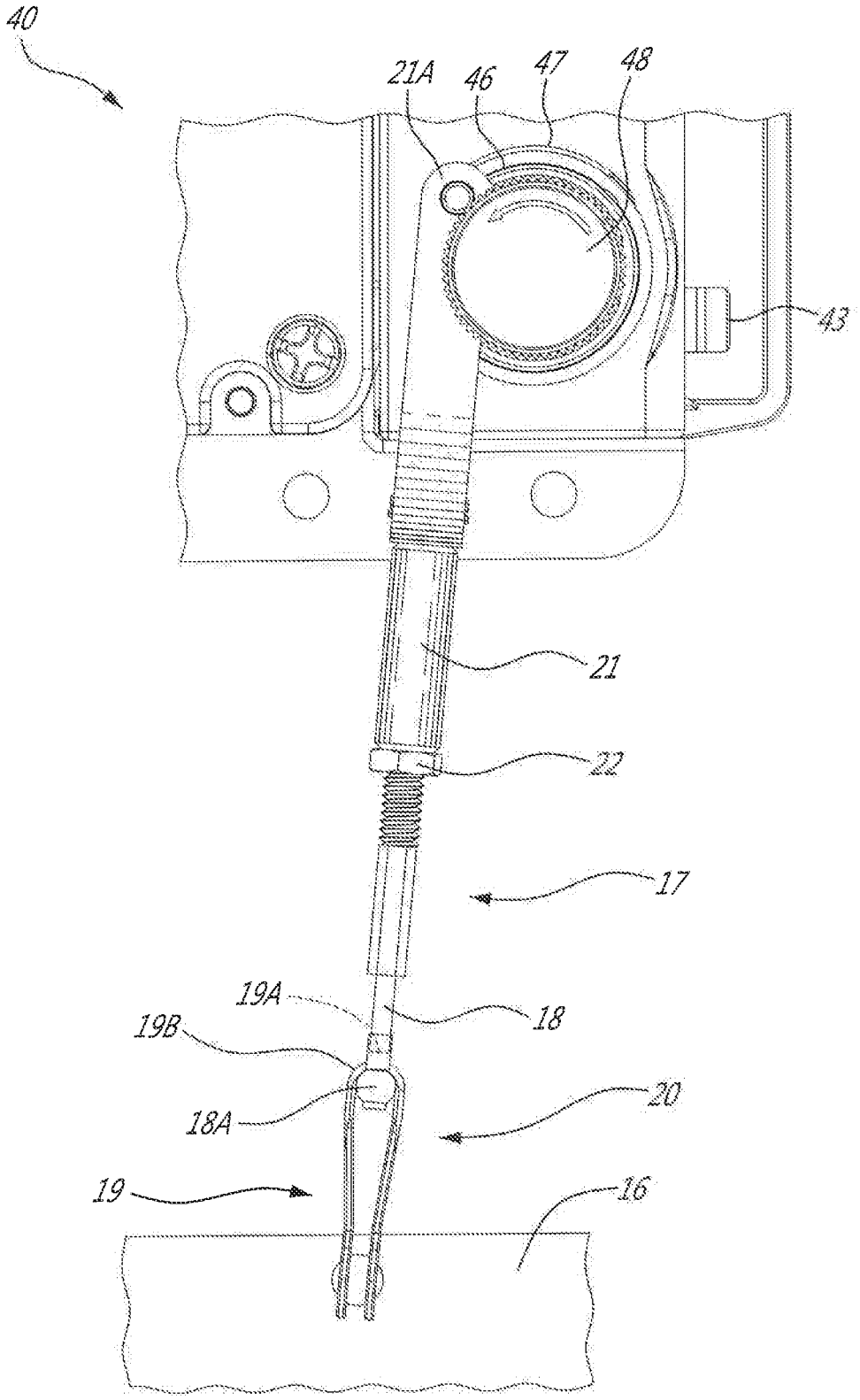
FIG. 3B is a front elevation view of the components shown in FIG. 3A, with the secondary lock in an open configuration.
Figure 3C:
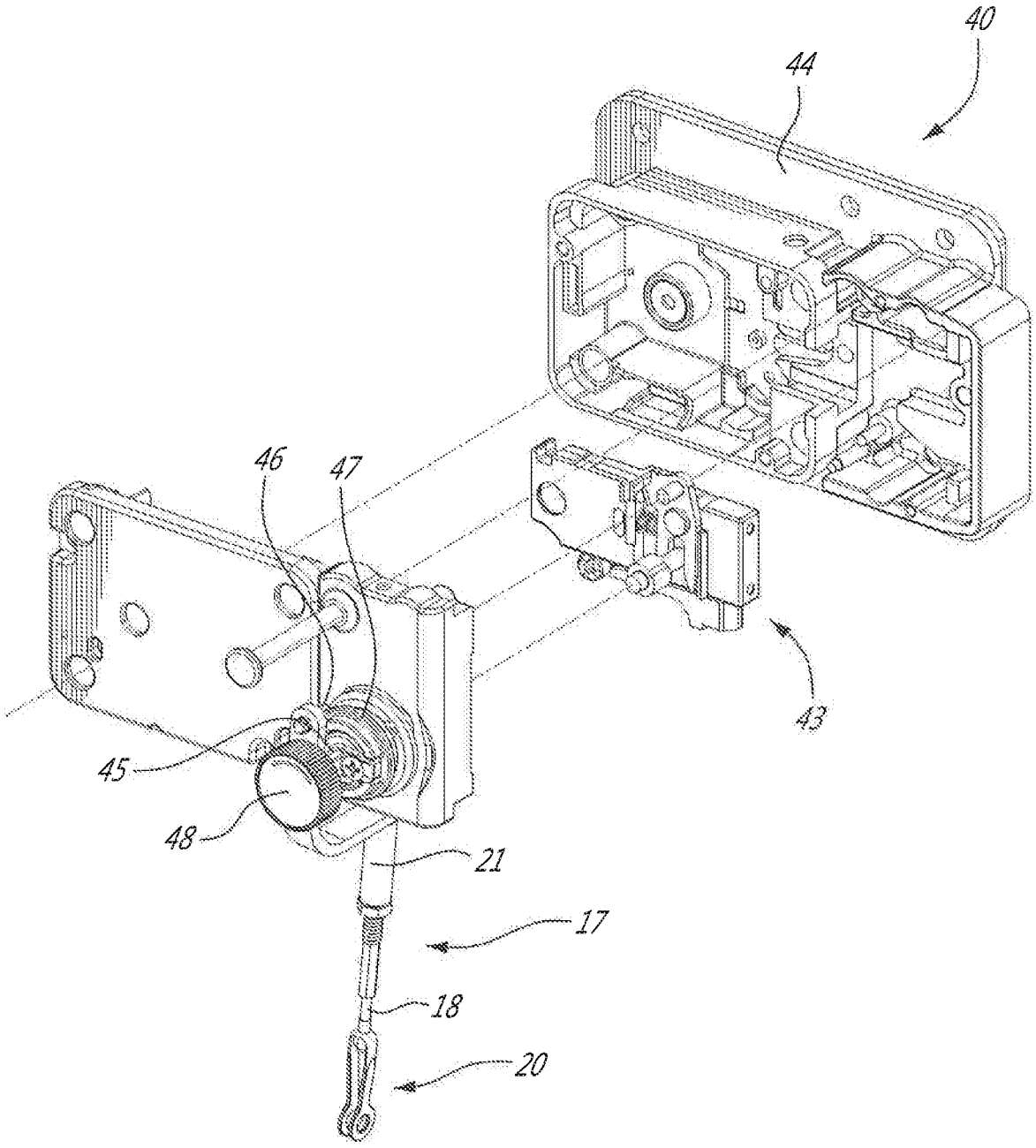
FIG. 3C is a partially exploded view of some components of the dual lock system of FIG. 1.

With reference to FIGS. 2 and 3, components of the example dual lock system 1 of FIG. 1 are shown in greater detail. The secondary lock 40 is a surface-mounted deadbolt lock. The second bolt retraction mechanism 42 has a rotary shaft 45 which is linked with the sliding extension-retraction movement of the second bolt 43 in a manner that the rotary shaft 45 rotates when the second bolt 43 is moved. More specifically, in this example, the rotary shaft 45 rotates clockwise when the second bolt 43 is extended, and rotates counter-clockwise when the second bolt 43 is retracted (the opposite can be true in an alternate embodiment).

As shown in FIG. 2, a mechanical link, which can be referred to as the second mechanical link, operably connects the internal handle 14 and the second lock mechanism 42. The mechanical link includes an actuator 16 which is moveable vertically in response to the activation of the handle 14. In this specific example, the internal handle 14 is of the turn-lever type, and the actuator 16 is linked to the movement of the internal handle 14 so as to move vertically up or down based on a corresponding angular direction of rotation of the handle 14, as will be presented below in fuller detail. The mechanical link further includes a connecting element 17 operably connected to the actuator 16 to transfer the vertical movement of the actuator 16 to a rotary movement of the rotary shaft 45. It will be noted that in this embodiment, the connecting element 17 is unilateral, as will now be explained.

Indeed, as shown more clearly in FIGS. 3A and 3B, in this embodiment, the connecting element 17 includes a stem 18 and a connector 19 which form a slide catch 20 with one another. More specifically, the stem 18 has a stop 18A, provided here in the form of a ball, at a distal end thereof, and the connector 19 has an aperture 19A in which the stem 18 is slidingly mounted, and a stop catch 19B adjacent the aperture 19A. In this embodiment, if the connector 19 is pulled downwardly by the actuator 16, the stop catch 19B will engage the stop 18A and pull the stem 18 downwardly (e.g. scenario shown in FIG. 3A). The connecting element 17 includes a rod 21 that has an end 21A pivotally connected to a cam 46 which is made integral to, and is spaced apart from the axis of, the rotary shaft 45, in a manner that if the stem 18 is pulled downwardly, the rod 21 will rotate the rotary shaft 45 and retract the second bolt 43. The cam 46 can optionally be integrated to a disc 47, as shown. On the other hand, if the rotary shaft 45 is rotated based on an external activation, the rod 21 will be driven into downward movement by the cam 46, but its force will not be transferred to the actuator 16. Rather, the stem 18 will slide in the aperture 19A of the connector 19 into the configuration shown in FIG. 3B, and the connector 19, and actuator 16, will not move. Alternate embodiments are possible. For instance, in an alternate embodiment, a cable can be used as a unilateral connecting element 17 to transfer force in a tension orientation but buckle in the opposite orientation.

In this specific embodiment, the connecting element 17 is provided with a turnbuckle 22 between the rod 21 and the stem 18. Coaxial rotation of the stem 18 relative to the rod 21 will, via the threaded "turnbuckle" engagement, extend or retract the length of the connecting element 17 based on the angular direction of rotation. This feature can allow to have fine adjustment ability of the length of the connecting element 17 in addition to the rigidity and robustness of the rod 21 configuration and was found suitable here. In this embodiment, the secondary lock 40, and more specifically the rotary shaft 45, is provided with a manually operable, optional, turn knob 48 on an internal face 2A of the door 2 to allow manual operation as an added safety precaution.

Figure 4:
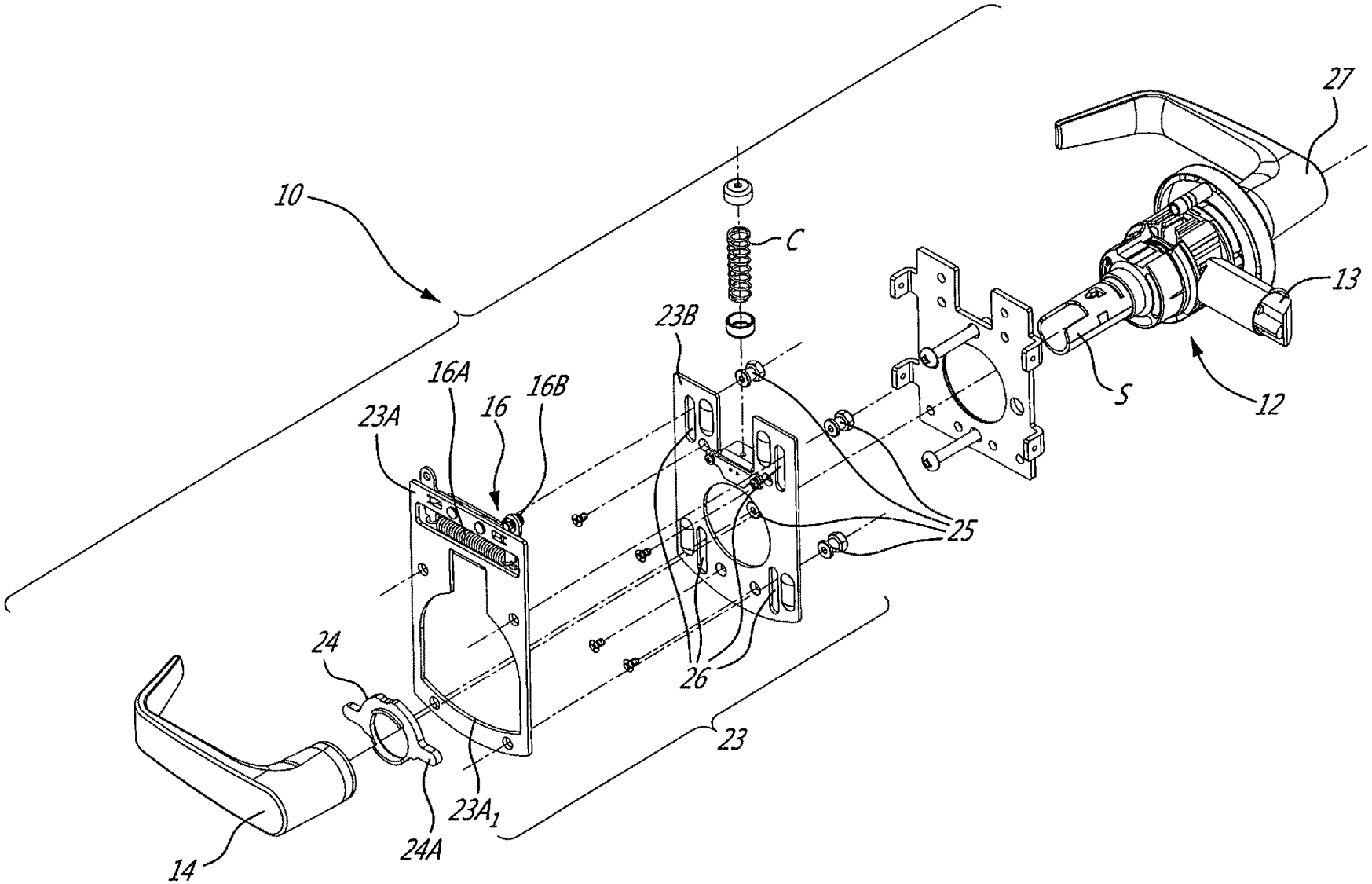
FIG. 4 is an exploded view based on FIG. 2.
Figure 4A:
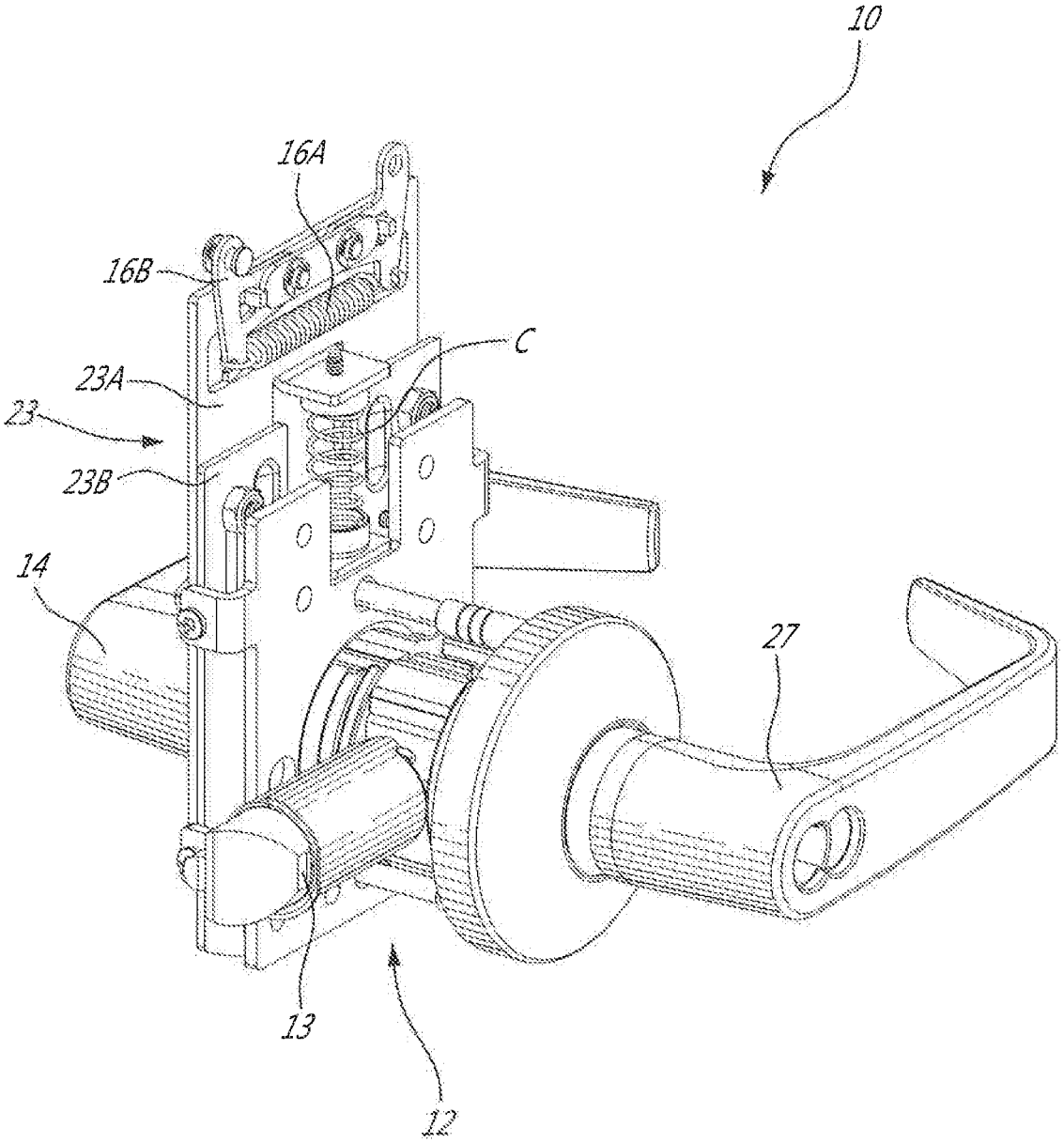
FIG. 4A is a perspective view of components of the dual lock system shown in FIG. 4, viewed from the back.

With additional reference to FIG. 2 and also referring to FIGS. 4 and 4A, the mechanical link between the internal handle 14 and the actuator 16 involves a sliding member assembly 23 and a cam member 24. In this embodiment, the sliding member assembly 23 includes a sliding plate 23A, which slides transversally relative to the axis of the shaft S of the handle assembly, and a fixed plate 23B. Both plates 23A, 23B are parallel to the door 2. The sliding plate 23A is slidingly connected to the fixed plate 23B. More particularly, in this embodiment, one or more (four in this specific embodiment) slider shaft 25 and slot engagements 26 can be provided to connect the sliding plate 23A and the fixed plate 23B. In this embodiment, the fixed plate 23B has the slots 26 and the shafts 25 are made integral to the sliding plate 23A, and protrude normal thereto into engagement with the slots 26, but the opposite can be true in alternate embodiments. The cam member 24 is provided here in the form of a collar which is made integral to the internal handle 14. The cam member 24 is provided with a cam 24A, and the sliding plate 23A is provided with a cam-receiving feature 23A1. As shown, in this embodiment, the actuator 16 is located at an upper end of the sliding plate 23A and includes a spring 16A extending parallel to the door 2. The spring 16A is connected at one end to the connecting member 16 link via a pivoting arm 16B connected to the sliding plate 23A. Such spring 16A (as part of that spring arrangement) is configured to keep excess force from being transferred into the connecting element 17 by extending when the second bolt 43 is retracted (e.g. by way of activation of the secondary lock 40) while the sliding plate 23A may still have some vertical travel it can undergo (e.g. by actuating the cam member 24 via the handle 14). In other words, upon activating the handle 14, the cam member 24 engages the cam-receiving feature 23A1 and the sliding plate 23A moves downward relative to the fixed plate 23B. The connecting element 17 being connected to the sliding plate 23A via the actuator 16, and more particularly in this case to the pivoting arm 16B and the spring 16A, is pulled downward and activate the secondary lock 40, whereby the second bolt 43 is retracted. As the second bolt 43 is fully retracted, the sliding plate 23A may still have some vertical downward travel it can undergo (e.g. by turning the handle 14 even more). That is, in order to avoid unnecessary tension force in the connecting element 17, the spring 16A, via a pivotal movement of the pivoting arm 16B may stretch to store the excess force that would have otherwise been imparted to the connecting element 17, whereby excess tension force in the connecting element 17 is avoided. Such spring arrangement may not be present in other embodiments, where the actuator 16 may be provided in the form of an upper end of the sliding plate 23A, without the spring 16A configuration.

When the shaft S is rotated, the cam 24A pushes against the cam-receiving feature 23$A_1$ which slides the sliding plate 23A vertically. The sliding plate 23A can be biased against the cam 24A, such as in this embodiment where this is achieved by a coil spring C which extends and is in a compressed state between corresponding features of the sliding plate 23A and of the fixed plate 23B, whereupon the coil spring C is further compressed when the sliding plate 23A is pushed by the cam 24A and is biased to extend back upon withdrawal of the cam's push. In this embodiment, the cam 24A pushes the sliding plate 23A downwardly, but it will be understood that in alternate embodiments, the cam 24A can push the sliding plate 23A upwardly. In this embodiment, the components are symmetrical and adapted to be suitable for both right-hand and left-hand side arrangements, but this is optional and asymmetrical components can be used instead.

As presented above, the second mechanical link which operably connect the internal handle 14 and the second lock/bolt retraction mechanism 42 is unilateral in the sense that force can be transferred to the second lock/bolt retraction mechanism 42 by the internal handle 14, but force cannot be transferred back from the second lock/bolt retraction mechanism 42 to the internal handle 14. Similarly, the mechanical link which is provided between the internal handle 14 and the first lock/bolt retraction mechanism 12, and which can be referred to as the first mechanical link to distinguish from the second mechanical link discussed above, can be unilateral. In other words, operation of the internal handle 14 transfers force which retracts the first bolt 13 via the first mechanism 12, but force otherwise exerted on the first bolt 13 or first mechanism 12 is not transferred back to the internal handle 14.

In this embodiment, the unilateral first mechanical link is a simple cylindrical-lock of the disconnected type. Such cylindrical locks of the disconnected type further have an outside turn-lever which can bear the first access control interface in the form of a keyhole for instance. The outside turn-lever (e.g. the external handle) 27 can only be turned when the keyhole is authenticated (i.e. by the insertion and rotation of a corresponding key), and a unidirectional mechanical link is provided between the outside turn-lever 27 and the first lock/bolt retraction mechanism 12, meaning that when the outside turn lever 27 is turned, the first bolt 13 is retracted, but the internal handle (e.g. internal turn-lever) 14 does not turn. On the other hand, when the internal handle 14 is turned, the first bolt 13 is retracted via the first lock mechanism 12. Such unilateral links in cylindrical locks of the disconnected type are known to persons having ordinary skill in the art and do not require further description.

As will now be understood, from the inside, a handle 14 can be provided on the inside face 2A of the door 2 which is connected to the mechanisms of both the primary lock 10 and of the secondary lock 40. From the explanation presented above, it will be understood that in this embodiment, during typical retraction of the first bolt 13 from the inside, the second bolt 43 will be disengaged and therefore not require retraction. However, from a safety perspective, it can be required that egress be ensured via a single handle activation. It will be understood that for security to be preserved, the mechanical links between the handle 14 and the two bolt retraction mechanisms 12, 42 can be of the unilateral type. In other words, the bolt retraction mechanisms 12, 42 can feature components which prevent the external activation of a first one of the two mechanisms via its corresponding access control interface to transfer over to the other mechanism and retract the other bolt via the handle connections. Examples of unilateral mechanical links are presented above, and it will be understood by persons having ordinary skill in the art that other unilateral mechanical links can be used in alternate embodiments. Similarly, it will be understood that other types of access control interfaces than the external turn-lever/keyhole example may be present in alternate embodiments. In most applications, the door 2 will have an external handle 27 which is pulled to open the door 2 when the bolts 13, 43 are retracted, but this external handle 27 will not be rotatable and/or will not form part of an access control interface in some alternate embodiments, such as can be the case when the access control interface is electronic rather than purely mechanical, for instance.

Referring back to FIG. 1, it will be noted that in this embodiment, a housing 50, which is shown in dotted lines to allow visibility of the components it covers, is provided and mounted on an internal face 2A of the door 2. As shown, the housing 50 covers the secondary lock/bolt retraction mechanism 42, the first lock/bolt retraction mechanism 12, and the connecting element 17. In some cases, such as shown, the secondary lock/bolt mechanism 42 is mounted on a frame 44, in this case a support plate, to which the second bolt 43 is extensibly mounted. The frame 44 is mounted (e.g. bolted) to the door 2. When such frame 44 is present, the housing 50 may cover the frame 44, the second mechanism 42, the first mechanism 12, and the connecting element 17.

Figure 5:
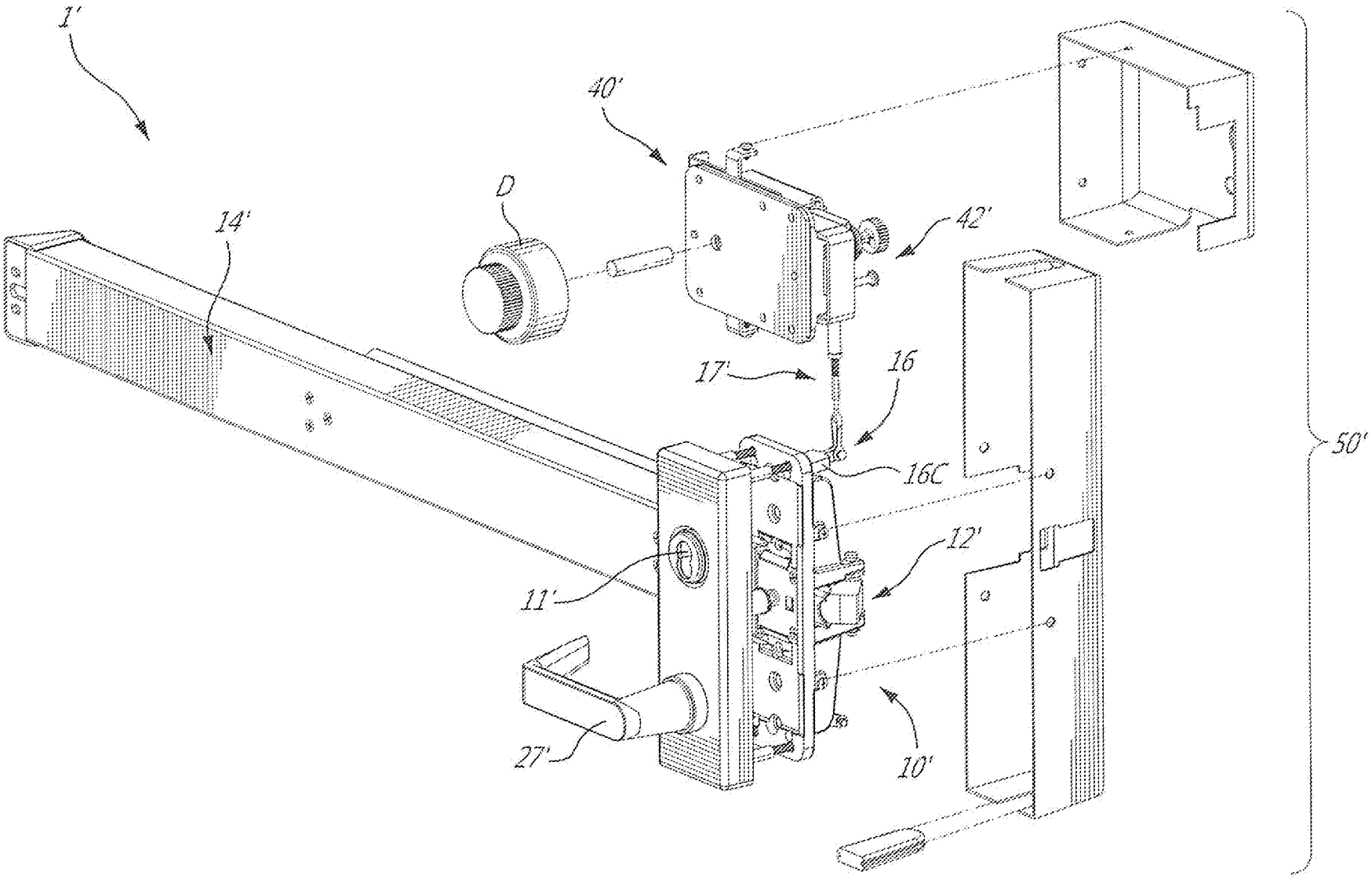
FIG. 5 is an exploded view of an alternate example of a dual lock system taken from the outside.
Figure 6:
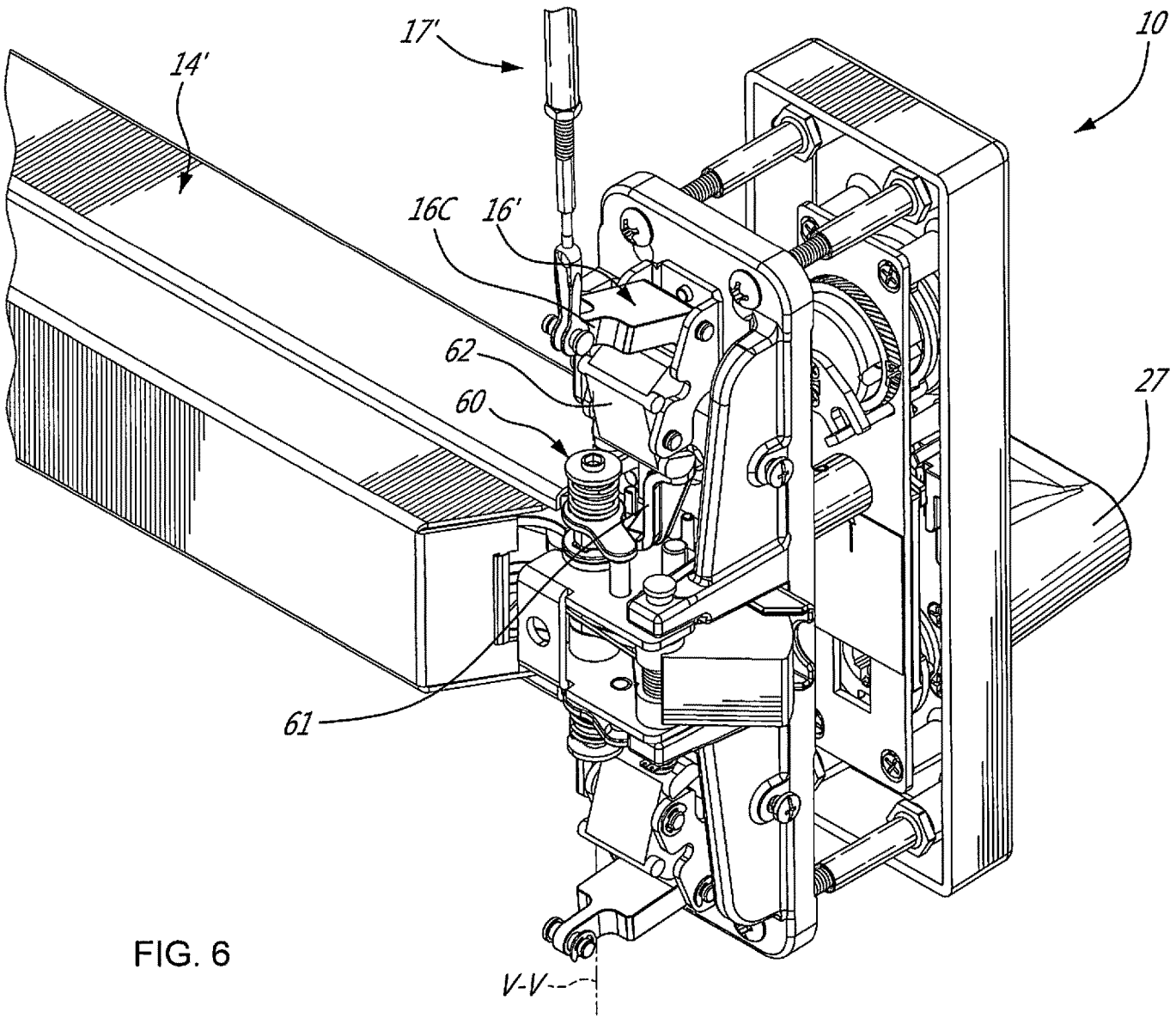
FIG. 6 is an oblique view of some components of the dual lock system of FIG. 5, taken from the inside and showing more detail.
Figure 7:
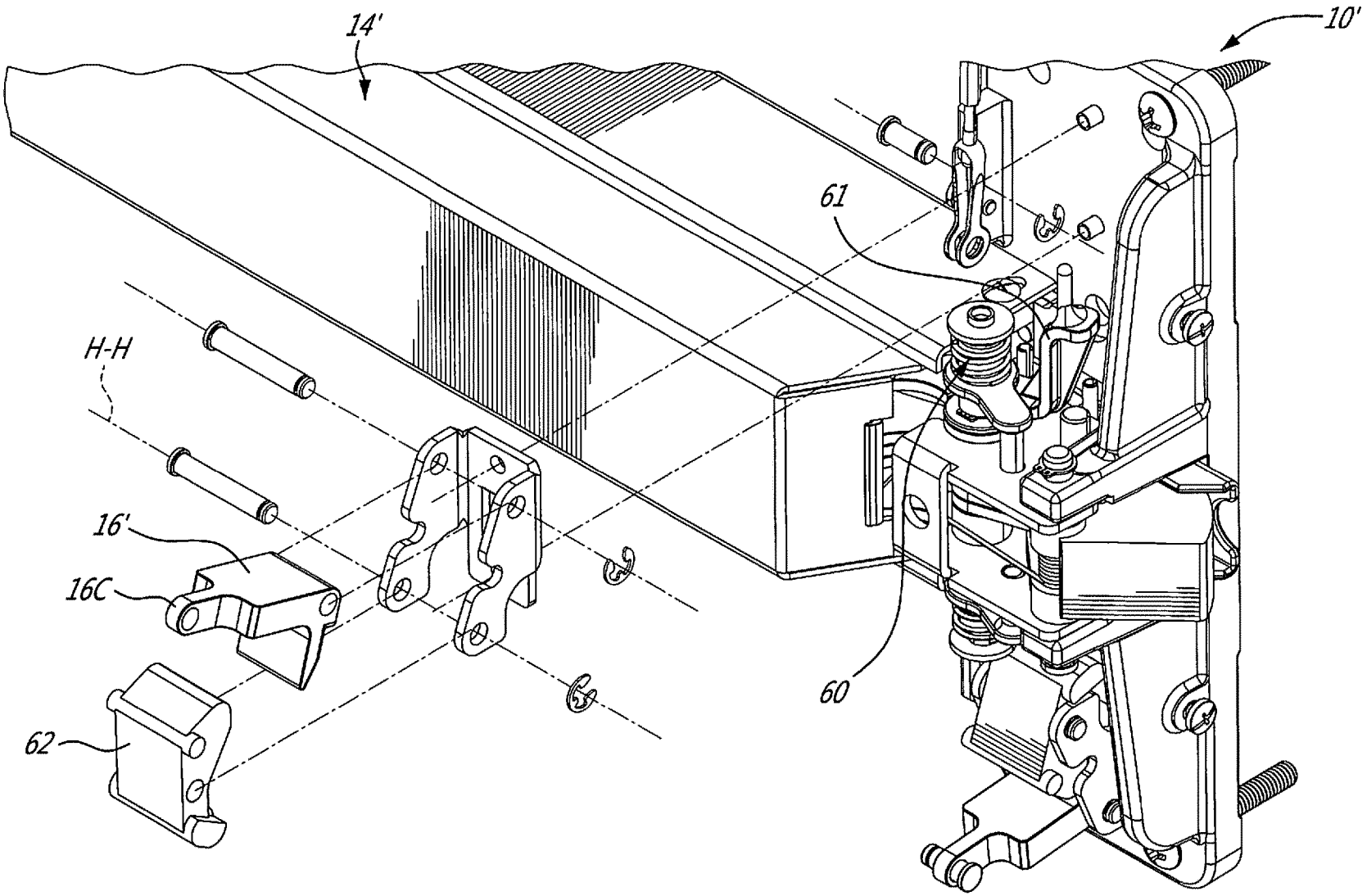
FIG. 7 is an exploded view of components of the dual lock system of FIG. 6, showing greater detail.

Referring now to FIGS. 5 to 7, an alternate embodiment of a dual lock system 1, which is denoted 1' below, is presented. The housing 50' covers the secondary lock/bolt retraction mechanism 42', the first lock/bolt retraction mechanism 12' and the connecting member 17'. In this embodiment, the internal handle 14' is a panic-bar. The first access control interface 11' of the primary lock 10' is a keyhole. The keyhole is not integral to the external handle 27' itself, but rather positioned adjacent thereto. It will be understood by persons having ordinary skill in the art that the mechanical link between the panic bar and the external handle 27' can be of the disconnected, unilateral type. The secondary lock 40' and connecting element 17' can be the same as the secondary lock 40 and connecting element 17 of the dual lock system 1 shown in FIGS. 1 to 4, or can be different in alternate embodiments. In this example, however, the actuator 16' is provided in the form of a pivoting member 16C, and more specifically a tip of a pivoting member 16C which is configured to pivot around a horizontal axis which is parallel to the door 2.

In this embodiment, the panic bar handle 14' generates a pivoting action of a trigger component 60 around a vertical pivot axis V-V (as opposed to the rotation action around a horizontal axis normal to the door 2 which was discussed above in relation to the turn-lever handle 14). This vertical axis pivoting action is converted into a horizontal axis pivoting action of the actuator 16'. This conversion is initially performed by a vertical to horizontal pivot converter 61 which is made integral to the trigger component 60. In this embodiment, the movement of the vertical to horizontal pivot converter 61 is translated to the actuator 16' via an intermediary rocker 62 which is designed to flip or pivot around an intermediary horizontal axis H-H. When the vertical to horizontal pivot converter 61 is pivoted around the vertical axis V-V, a cam-bearing arm thereof pivots in a horizontal plane and toggles the intermediary rocker 62, which pivots in a vertical plane. The intermediary rocker 62 transmits its motion and toggles the pivoting member 16C bearing the actuator 16', and the actuator 16' is moved vertically by the pivoting of the pivoting member 16C in a vertical plane. It will be understood that a push-pull paddle handle can generate a similar pivoting movement than a panic bar, and can be used in the handle in alternate embodiments. It will also be understood that in alternate embodiments, the intermediary rocker 62 can be omitted, and a vertical to horizontal pivot converter 61 can be directly engaged to pivot an actuator member, for instance.

Figure 8:
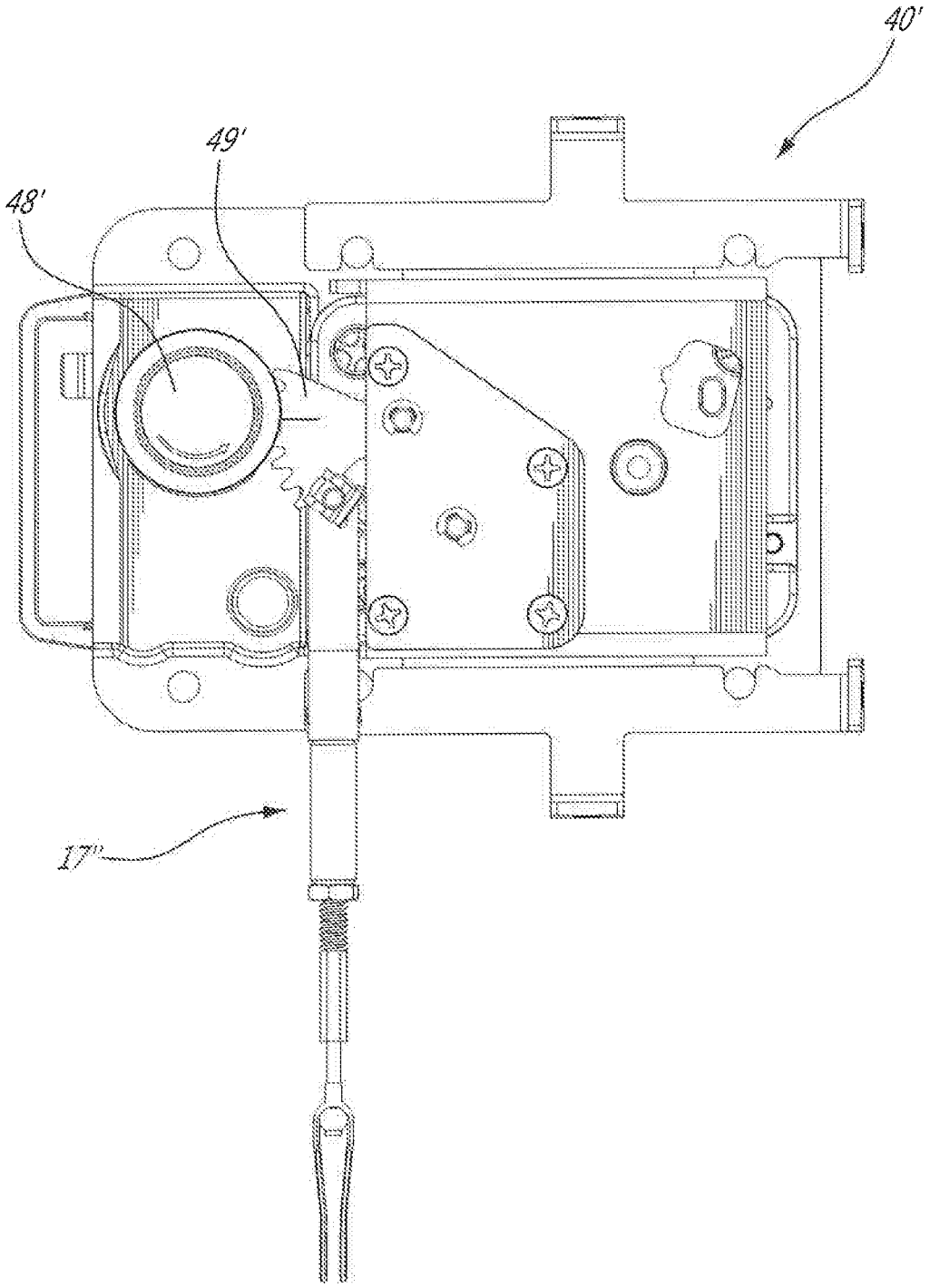
FIG. 8 is a front elevation view of a variant of the secondary lock.
Figure 9:
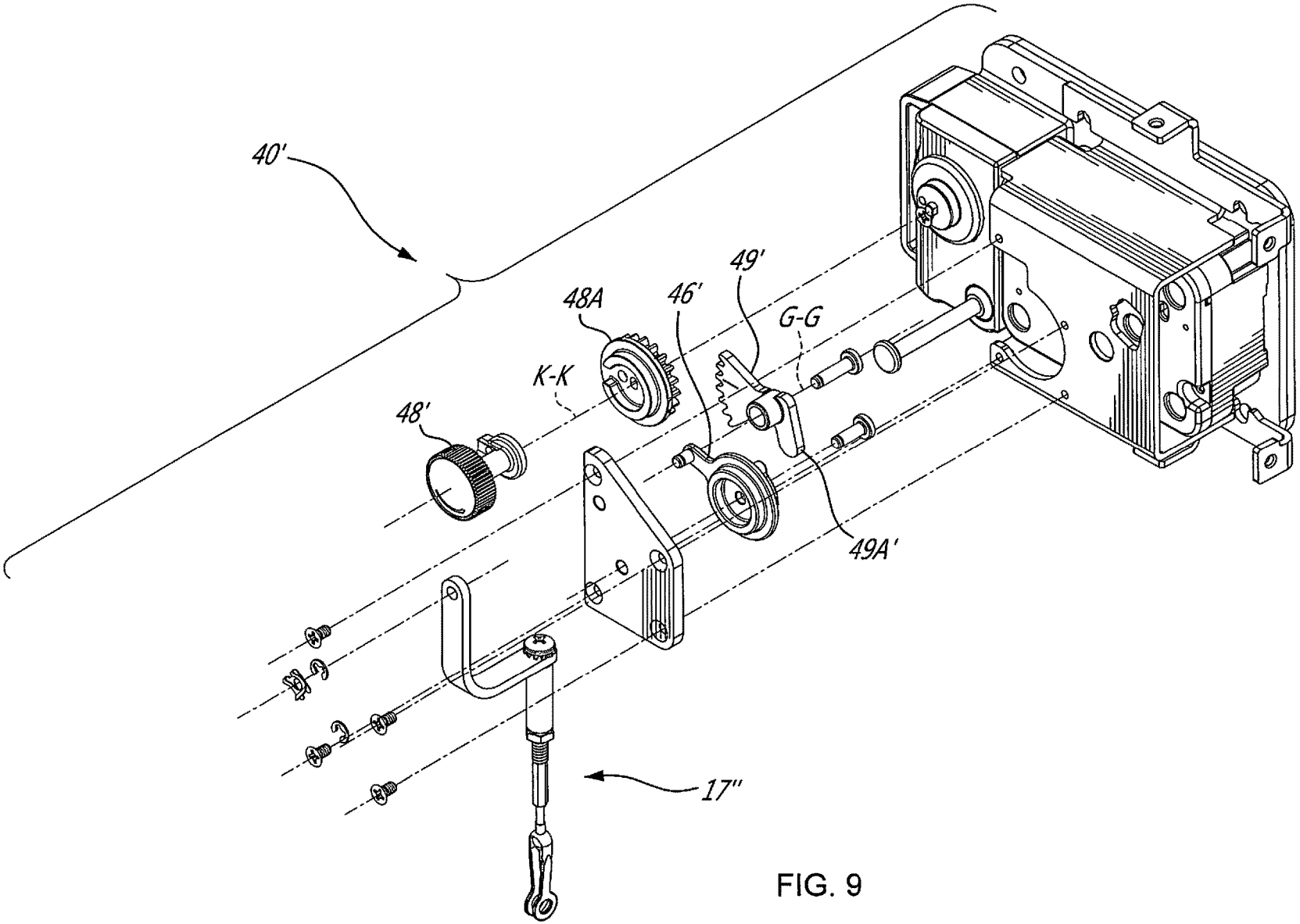
FIG. 9 is an exploded view of components of the variant of the secondary lock of FIG. 8.

Referring to FIGS. 8 and 9, a variant of the secondary lock 40, which is denoted 40' below, is provided. The secondary lock 40' functions similarly as discussed above, but for the aspects discussed below. The secondary lock 40' has a sector gear 49' engaged with the cam 46' and a knob gear 48A mounted to the rotary shaft 45', which may be connected to a knob 48' such as shown. In operation, when the sliding member (not shown in FIGS. 8 and 9, but similar to sliding member 23A discussed above) pulls down the connecting element 17", the connecting element 17" in turn pulls the cam 46' down, whereby the cam 46' rotates in a counter clockwise direction, and whereby the sector gear 49' is rotated in a clockwise direction by the engagement of the cam 46' with a cam abutment surface 49A' on the sector gear 49'. The sector gear 49' thus rotates about its rotation axis G-G normal to the door 2. As such, while the sector gear 49' rotates, teeth of the sector gear 49' drivingly engage corresponding teeth of the knob gear 48A, whereby rotation about its rotation axis K-K normal to the door 2, in this case in a counter clockwise direction, of the knob gear 48A (and then the knob 48' itself when present) occurs. When this occurs, the second bolt 43' of the secondary lock 40' may retract. As such, upon activating either one of the first external access control interface 11' and the handle 14', the second bolt 43' may retract. Although such secondary lock 40' may be suitable for a left hand door configuration, said secondary lock 40' may also be used for right hand door configuration.

As can be understood, the examples described above and illustrated are intended to be exemplary only. In the example embodiments presented above, the mechanisms by which the corresponding bolts are retracted based on the triggering of the access control interface are purely mechanical in nature, and the access control interfaces themselves are mechanical as well (e.g. key/keyhole, combination dial, push-button keypad). It will be understood that in alternate embodiments, the mechanisms by which the corresponding bolts are retracted can include electromagnetic components, such as a solenoid bolt actuator for instance. Mechanisms based on electromagnetically applied force can be particularly well suited for access control interfaces being partially or fully electronics-based, such as electronic keypads, RFID badges, smartphone activated devices for instance, and such access control interfaces can be used in alternate embodiments. Moreover, in the example embodiments presented above, the second bolt, the second mechanism, the first mechanism, and the connecting element are mounted on an inner face of the door and are enclosed within a suitable housing. In alternate embodiments, some, or all of these components can be embedded into the door itself, in a mortise-type arrangement. The scope is indicated by the appended claims.

The invention claimed is:

1. A dual lock system for a door, the dual lock system comprising:

a primary lock having a first bolt, a first external access control interface, a handle on an internal face of the door, a first mechanism to control the retraction of the first bolt based on an activation of either one of the first external access control interface and the handle, the first mechanism having an actuator which is moveable vertically in response to the activation of the handle;

a secondary lock having a second bolt, a second external access control interface, a second mechanism to control the retraction of the second bolt upon activating the second external access control interface, the second mechanism having a rotary shaft linked to the retraction of the second bolt;

a connecting element connected between the actuator and the rotary shaft, wherein vertical movement of the actuator is transferred to a rotary movement of the rotary shaft via the connecting element, and both the first bolt and the second bolt are retracted upon activation of the handle;

wherein the connecting element has a rod having a first end pivotally connected to a cam, the cam being integral to the rotary shaft.

2. The dual lock system of claim 1 further comprising a housing mounted on the internal face of the door and covering a frame to which the second bolt is extendibly mounted, the second mechanism, the first mechanism, and the connecting element.

3. The dual lock system of claim 1 wherein the second external access control interface has a combination dial positioned on an external face of the door.

4. The dual lock system of claim 1 wherein the connecting element further has a slide catch operable to transfer linear force unilaterally between the actuator and the cam.

5. The dual lock system of claim 4 wherein the slide catch includes a stem made integral to the rod and having a stop at an end thereof, and a connector having an aperture slidingly engaged with the stem, a stop catch adjacent the aperture configured for unilateral engagement with the stop, the connector extending from the stop catch, opposite the stem and connecting to the actuator.

6. The dual lock system of claim 1 wherein a unilateral mechanical link is provided between the first external access control interface and the internal handle, the unilateral mechanical link transmitting first bolt retraction forces between both the first external access control interface and the internal handle to the first mechanism and first bolt, but not from the first external access control interface to the internal handle.

7. The dual lock system of claim 1 wherein the internal handle is a turn-lever.

8. The dual lock system of claim 7 the first external access control interface is a keyhole configured for authenticating a key by allowing rotation of an external handle, wherein said rotation of said external handle is mechanically linked to the first mechanism but not to the internal handle.

9. The dual lock system of claim 1 wherein the handle is a panic bar.

10. The dual lock system of claim 1, wherein the second mechanism includes a knob gear mounted to the rotary shaft of the second mechanism, and a sector gear drivingly engaged to the knob gear, the sector gear being driven in rotation by the cam upon activating either one of the first external access control interface and the handle.

11. A dual lock system for a door, the dual lock system comprising:

a primary lock having a first bolt, a first external access control interface, a handle on an internal face of the door, a first mechanism to control the retraction of the first bolt based on an activation of either one of the first external access control interface and the handle, the first mechanism having an actuator which is moveable vertically in response to the activation of the handle;

a secondary lock having a second bolt, a second external access control interface, a second mechanism to control the retraction of the second bolt upon activating the second external access control interface, the second mechanism having a rotary shaft linked to the retraction of the second bolt;

a connecting element connected between the actuator and the rotary shaft, wherein vertical movement of the actuator is transferred to a rotary movement of the rotary shaft via the connecting element, and both the first bolt and the second bolt are retracted upon activation of the handle;

wherein the internal handle is a turn-lever and wherein the turn-lever has a cam member made integral thereto and rotatable around a horizontal axis normal to the door, further comprising a sliding member assembly including a fixed member fixed relative to the horizontal axis, and a sliding member slidably mounted to the fixed member for vertical relative movement, the sliding member having a cam receiving feature being engaged upon by the cam member upon rotation of the shaft and driving said vertical relative movement, said actuator being integral to said sliding member.

12. The dual lock system of claim 11 wherein the sliding member is a sliding plate, and the fixed member is a fixed plate, the sliding plate and the fixed plate being slidingly connected to one another via a slider shaft and vertically-oriented slot engagement.

13. The dual lock system of claim 11, wherein the actuator is located at an upper end of the sliding member and includes a spring connected at one end to the connecting element via a pivoting arm connected to the sliding member.

14. The dual lock system of claim 11 further comprising a housing mounted on the internal face of the door and covering a frame to which the second bolt is extendibly mounted, the second mechanism, the first mechanism, and the connecting element.

15. The dual lock system of claim 11 wherein the second external access control interface has a combination dial positioned on an external face of the door.

16. The dual lock system of claim 11 wherein a unilateral mechanical link is provided between the first external access control interface and the internal handle, the unilateral mechanical link transmitting first bolt retraction forces between both the first external access control interface and the internal handle to the first mechanism and first bolt, but not from the first external access control interface to the internal handle.

17. A dual lock system for a door, the dual lock system comprising:

a primary lock having a first bolt, a first external access control interface, a handle on an internal face of the door, a first mechanism to control the retraction of the first bolt based on an activation of either one of the first external access control interface and the handle, the first mechanism having an actuator which is moveable vertically in response to the activation of the handle;

a secondary lock having a second bolt, a second external access control interface, a second mechanism to control the retraction of the second bolt upon activating the second external access control interface, the second mechanism having a rotary shaft linked to the retraction of the second bolt;

a connecting element connected between the actuator and the rotary shaft, wherein vertical movement of the actuator is transferred to a rotary movement of the rotary shaft via the connecting element, and both the first bolt and the second bolt are retracted upon activation of the handle;

wherein the first mechanism further comprises a vertical to horizontal pivot convertor having a cam pivoting in a horizontal plane and configured to trigger a pivoting of the actuator around a horizontal pivot axis.

18. The dual lock system of claim 17 further comprising a housing mounted on the internal face of the door and covering a frame to which the second bolt is extendibly mounted, the second mechanism, the first mechanism, and the connecting element.

19. The dual lock system of claim 17 wherein the second external access control interface has a combination dial positioned on an external face of the door.

20. The dual lock system of claim 17 wherein a unilateral mechanical link is provided between the first external access control interface and the internal handle, the unilateral mechanical link transmitting first bolt retraction forces between both the first external access control interface and the internal handle to the first mechanism and first bolt, but not from the first external access control interface to the internal handle.

* * * * *